US008169339B2

(12) United States Patent
Kawai et al.

(10) Patent No.: US 8,169,339 B2
(45) Date of Patent: May 1, 2012

(54) TRAFFIC SITUATION DISPLAY METHOD, TRAFFIC SITUATION DISPLAY SYSTEM, IN-VEHICLE DEVICE, AND COMPUTER PROGRAM

(75) Inventors: Jun Kawai, Kawasaki (JP); Katsutoshi Yano, Kawasaki (JP); Hiroshi Yamada, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 309 days.

(21) Appl. No.: 12/478,971

(22) Filed: Jun. 5, 2009

(65) Prior Publication Data

US 2009/0267801 A1 Oct. 29, 2009

Related U.S. Application Data

(63) Continuation of application No. PCT/JP2006/324199, filed on Dec. 5, 2006.

(51) Int. Cl.
*G08G 1/09* (2006.01)

(52) U.S. Cl. ..... 340/905; 340/990

(58) Field of Classification Search ..... 340/990, 340/991, 992, 993, 994, 995, 905.99; 348/143–159
See application file for complete search history.

(56) References Cited

U.S. PATENT DOCUMENTS 4,402,050 A * 8/1983 Tagami et al. ..... 701/300
5,113,185 A * 5/1992 Ichikawa ..... 340/995.27
5,283,573 A * 2/1994 Takatou et al. ..... 340/937
5,301,239 A * 4/1994 Toyama et al. ..... 382/104
5,530,420 A * 6/1996 Tsuchiya et al. ..... 340/435
5,809,161 A * 9/1998 Auty et al. ..... 382/104
5,874,905 A * 2/1999 Nanba et al. ..... 340/995.2
5,911,774 A * 6/1999 Itoh ..... 701/207
5,925,091 A * 7/1999 Ando ..... 701/212
6,075,874 A * 6/2000 Higashikubo et al. ..... 382/104
6,097,313 A * 8/2000 Takahashi et al. ..... 340/905
6,121,900 A * 9/2000 Takishita ..... 340/995.11

(Continued)

FOREIGN PATENT DOCUMENTS

JP 4-242500 8/1992

(Continued)

OTHER PUBLICATIONS

International Search Report for International Application No. PCT/JP2006/324199 dated Jan. 10, 2007.

(Continued)

*Primary Examiner* — Daniel Wu
*Assistant Examiner* — Rufus Point
(74) *Attorney, Agent, or Firm* — Kratz, Quintos & Hanson, LLP

(57) ABSTRACT

There is provided a method for displaying a traffic situation in a traffic situation display system, the method comprising: transmitting image data obtained by imaging an imaging region including roads from a road-side device; receiving the transmitted image data in an in-vehicle device; displaying an image on the basis of the received image data; storing, by the road-side device, corresponding information in which a pixel coordinate in the image and positional information of the imaging region are corresponded to each other; transmitting, by the road-side device, the stored corresponding information; receiving, by the in-vehicle device, the corresponding information; acquiring, by the in-vehicle device, positional information of an own vehicle; specifying, by the in-vehicle device, an own vehicle position on the image based on the received corresponding information and the acquired positional information; and displaying, by the in-vehicle device, the specified own vehicle position on the image.

10 Claims, 17 Drawing Sheets

U.S. PATENT DOCUMENTS

| | | | | |
|---|---|---|---|---|
| 6,140,943 | A * | 10/2000 | Levine | 340/995.12 |
| 6,204,778 | B1 * | 3/2001 | Bergan et al. | 340/936 |
| 6,236,933 | B1 * | 5/2001 | Lang | 701/117 |
| 6,243,030 | B1 * | 6/2001 | Levine | 340/995.12 |
| 6,574,548 | B2 * | 6/2003 | DeKock et al. | 701/117 |
| 6,775,614 | B2 * | 8/2004 | Kim | 701/213 |
| 6,956,503 | B2 * | 10/2005 | Yokokohji et al. | 340/988 |
| 7,054,746 | B2 * | 5/2006 | Kodani et al. | 701/212 |
| 7,215,254 | B2 * | 5/2007 | Tauchi | 340/903 |
| 7,313,265 | B2 * | 12/2007 | Nakai et al. | 382/154 |
| 7,349,799 | B2 * | 3/2008 | Joe et al. | 701/117 |
| 7,375,622 | B2 * | 5/2008 | Takata et al. | 340/436 |
| 7,420,589 | B2 * | 9/2008 | Kamijo et al. | 348/149 |
| 7,423,553 | B2 * | 9/2008 | Yokokohji et al. | 340/937 |
| 2001/0012982 | A1 * | 8/2001 | Ogura et al. | 701/301 |
| 2001/0020902 | A1 * | 9/2001 | Tamura | 340/905 |
| 2001/0056326 | A1 * | 12/2001 | Kimura | 701/208 |
| 2002/0135471 | A1 * | 9/2002 | Corbitt et al. | 340/436 |
| 2002/0194213 | A1 * | 12/2002 | Takayanagi | 707/500 |
| 2003/0078724 | A1 * | 4/2003 | Kamikawa et al. | 701/208 |
| 2003/0225516 | A1 * | 12/2003 | DeKock et al. | 701/214 |
| 2004/0204833 | A1 * | 10/2004 | Yokota | 701/208 |
| 2005/0122235 | A1 * | 6/2005 | Teffer et al. | 340/937 |
| 2005/0154505 | A1 * | 7/2005 | Nakamura et al. | 701/1 |
| 2007/0276600 | A1 * | 11/2007 | King et al. | 701/301 |
| 2008/0004799 | A1 * | 1/2008 | Takahashi | 701/208 |
| 2009/0091477 | A1 * | 4/2009 | Mc Call et al. | 340/990 |

FOREIGN PATENT DOCUMENTS

| | | | |
|---|---|---|---|
| JP | 8-129700 | | 5/1996 |
| JP | 11-108684 | | 4/1999 |
| JP | 11-160080 | | 6/1999 |
| JP | 2947947 | B1 | 7/1999 |
| JP | 2000-259818 | | 9/2000 |
| JP | 2003-202235 | A1 | 7/2003 |
| JP | 2004-077281 | | 3/2004 |
| JP | 2004-94862 | A1 | 3/2004 |
| JP | 2004-146924 | A1 | 5/2004 |
| JP | 2004-310189 | A1 | 11/2004 |
| JP | 3655119 | B1 | 3/2005 |
| JP | 2006-215911 | A1 | 8/2006 |
| WO | WO01/82261 | | 11/2001 |

OTHER PUBLICATIONS

European Search Report dated Dec. 8, 2010, issued in European patent application No. 06833954.8.

* cited by examiner

FIG. 8

| IDENTFIER OF VIDEO CAMERA | CONVERSION EQUATION |
|---|---|
| 001 | $(x, y) = F_1 (n, e)$ |
| 002 | $(x, y) = F_2 (n, e)$ |
| ⋮ | ⋮ |

FIG. 9

| PIXEL COORDINATES | POSITION COORDINATES |
|---|---|
| ( 0 , 0 ) | (LATITUDE NORTH XXX, LONGITUDE EAST OOO) |
| ( 1 , 0 ) | (LATITUDE NORTH XXO, LONGITUDE EAST OOX) |
| ⋮ | ⋮ |
| (639, 0 ) | (LATITUDE NORTH ΔΔΔ, LONGITUDE EAST ΔΔX) |
| ( 0 , 1 ) | (LATITUDE NORTH XXΔ, LONGITUDE EAST OOO) |
| ( 1 , 1 ) | (LATITUDE NORTH XXΔ, LONGITUDE EAST OOX) |
| ⋮ | ⋮ |
| (639,479) | (LATITUDE NORTH ΔΔX, LONGITUDE EAST ΔΔX) |

FIG. 10

| POSITION COORDINATES | PIXEL COORDINATES |
|---|---|
| (LATITUDE NORTH 36, 50, 43, LONGITUDE EAST 138, 20, 29) | ( 0 , 0 ) |
| (LATITUDE NORTH 36, 50, 43, LONGITUDE EAST 138, 20, 30) | ( 90 , 0 ) |
| ⋮ | ⋮ |
| (LATITUDE NORTH 36, 50, 43, LONGITUDE EAST 138, 20, 35) | (639, 0 ) |
| (LATITUDE NORTH 36, 50, 42, LONGITUDE EAST 138, 20, 29) | ( 0 , 80 ) |
| ⋮ | ⋮ |

FIG. 12A

| PRIORITY | MONITORING DIRECTION |
|---|---|
| 1 | STRAIGHT DIRECTION |
| 2 | LEFT TURN DIRECTION |
| 3 | RIGHT TURN DIRECTION |

FIG. 12B

| PRIORITY | IMAGING ORIENTATION |
|---|---|
| 1 | SOUTH |
| 2 | WEST |
| 3 | EAST |

FIG. 12C

| PRIORITY | MONITORING DIRECTION |
|---|---|
| 1 | RIGHT TURN DIRECTION |
| 2 | — |
| 3 | — |

FIG. 12D

| PRIORITY | IMAGING ORIENTATION |
|---|---|
| 1 | SOUTH |
| 2 | — |
| 3 | — |

TRAFFIC SITUATION DISPLAY METHOD, TRAFFIC SITUATION DISPLAY SYSTEM, IN-VEHICLE DEVICE, AND COMPUTER PROGRAM

This application is a continuation, filed under 35 U.S.C. §111(a), of PCT International Application No. PCT/JP2006/324199 which has an international filing date of Dec. 5, 2006 and designated the United States of America.

FIELD

The embodiments relate to a traffic situation display method for receiving image data obtained by imaging an imaging region including roads in an in-vehicle device and displaying the traffic situation in a front of the vehicle on the basis of the received image data; a traffic situation display system; an in-vehicle device configuring the traffic situation display system; and a computer program for causing the in-vehicle device to display the traffic situation.

BACKGROUND

A system is proposed in which areas that are hard for a driver of the vehicle to see such as intersection or blind corner are imaged with a video camera installed on the road, the image data obtained by imaging is transmitted to the in-vehicle device, and the in-vehicle device receives the image data and displays the image on an in-vehicle monitor on the basis of the received image data to allow the driver to check the traffic situation in a front of the vehicle thereby enhancing the traveling safety of the vehicle.

For example, a vehicle drive assisting device is proposed in which a situation of the road at the intersection is imaged such that a given orientation is always on the upper side of the screen, an intersection image signal obtained through such imaging is transmitted to a given region having the intersection as the center, reception part of the vehicle receives the intersection image signal when the vehicle enters such region, and the received intersection image signal is converted and displayed such that a signal direction of the vehicle is on the upper side of the screen, so that other vehicles entering the intersection from other roads can be accurately grasped thereby enhancing the traveling safety of the vehicle (see Patent Document 1).

A situation information providing device is proposed in which an image of a location that is hard to check from the position of the passenger of the vehicle is imaged with an imaging device installed at a distant point, and the imaged image is processed and presented so as to be easily and intuitively understood by the passenger thereby enhancing the content of the safety check of the traffic (see Patent Document 2).

Furthermore, an in-vehicle device is proposed in which an advancing direction of the vehicle and an imaging direction of a road-side device are identified in the in-vehicle device, and the image imaged with the road-side device is rotatably processed and displayed such that the advancing direction of the vehicle faces the upper direction, so that whether the lane of the advancing direction of the driving vehicle jammed or whether the opposite lane is jammed can be clarified when the imaged image depicting the state in which the roads are jammed is displayed, thereby enhancing the convenience of the driver (see Patent Document 3).

[Patent Document 1] Japanese Patent No. 2947947

[Patent Document 2] Japanese Patent No. 3655119

[Patent Document 3] Japanese Laid-Open Patent Publication No. 2004-310189

SUMMARY

However, in the devices of Patent Documents 1 to 3, the image is rotated or processed to a direction complying with an advancing direction of the vehicle in the road-side device side or the in-vehicle device side, and the processed image is displayed to allow the passenger to easily recognize the image imaged with the road-side device and the like, but the image imaged with the road-side device is not the image seen from the own vehicle, and thus the driver cannot immediately judge the position of the own vehicle on the displayed image and cannot grasp which location (e.g., other vehicle, pedestrian, etc.) on the image the driver needs to pay attention to in relation to the position of the own vehicle, and further enhancement of the traffic safety is desired.

The present technique is provided in view of the above situations, and aims to provide a traffic situation display method capable of enhancing the safety of the traffic by displaying the position of the own vehicle on the image imaged with the imaging region including roads, a traffic situation display system, an in-vehicle device configuring the traffic situation display system, and a computer program for causing the in-vehicle device to display the traffic situation.

There is provided a traffic situation display method according to an aspect, the method being for displaying a traffic situation in a traffic situation display system, the method including: transmitting image data obtained by imaging an imaging region including roads from a road-side device; receiving the transmitted image data in an in-vehicle device; displaying an image on the basis of the received image data; storing, by the road-side device, corresponding information in which a pixel coordinate in the image and positional information of the imaging region are corresponded to each other; transmitting, by the road-side device, the stored corresponding information; receiving, by the in-vehicle device, the corresponding information; acquiring, by the in-vehicle device, positional information of an own vehicle; specifying, by the in-vehicle device, an own vehicle position on the image on the basis of the received corresponding information and the acquired positional information; and displaying, by the in-vehicle device, the specified own vehicle position on the image.

According to the aspect, the own vehicle position can be displayed on the image and the safety of traffic can be enhanced even in the low cost in-vehicle device having a simple function.

The object and advantages of the embodiment discussed herein will be realized and attained by means of elements and combinations particularly pointed out in the claims.

It is to be understood that both the foregoing general description and the following detailed and the following detailed description are exemplary and only are not restrictive exemplary explanatory are not restrictive of the invention, as claimed.

BRIEF DESCRIPTION OF DRAWINGS

FIG. 8 is an explanatory view illustrating a relationship of the identifier of the video camera and the conversion equation;

FIG. 9 is an explanatory view illustrating another example of corresponding information;

FIG. 10 is an explanatory view illustrating another example of corresponding information;

FIGS. 12A to 12D are explanatory views illustrating an example of a priority table for selecting the video camera;

DESCRIPTION OF EMBODIMENTS

Figure 1:
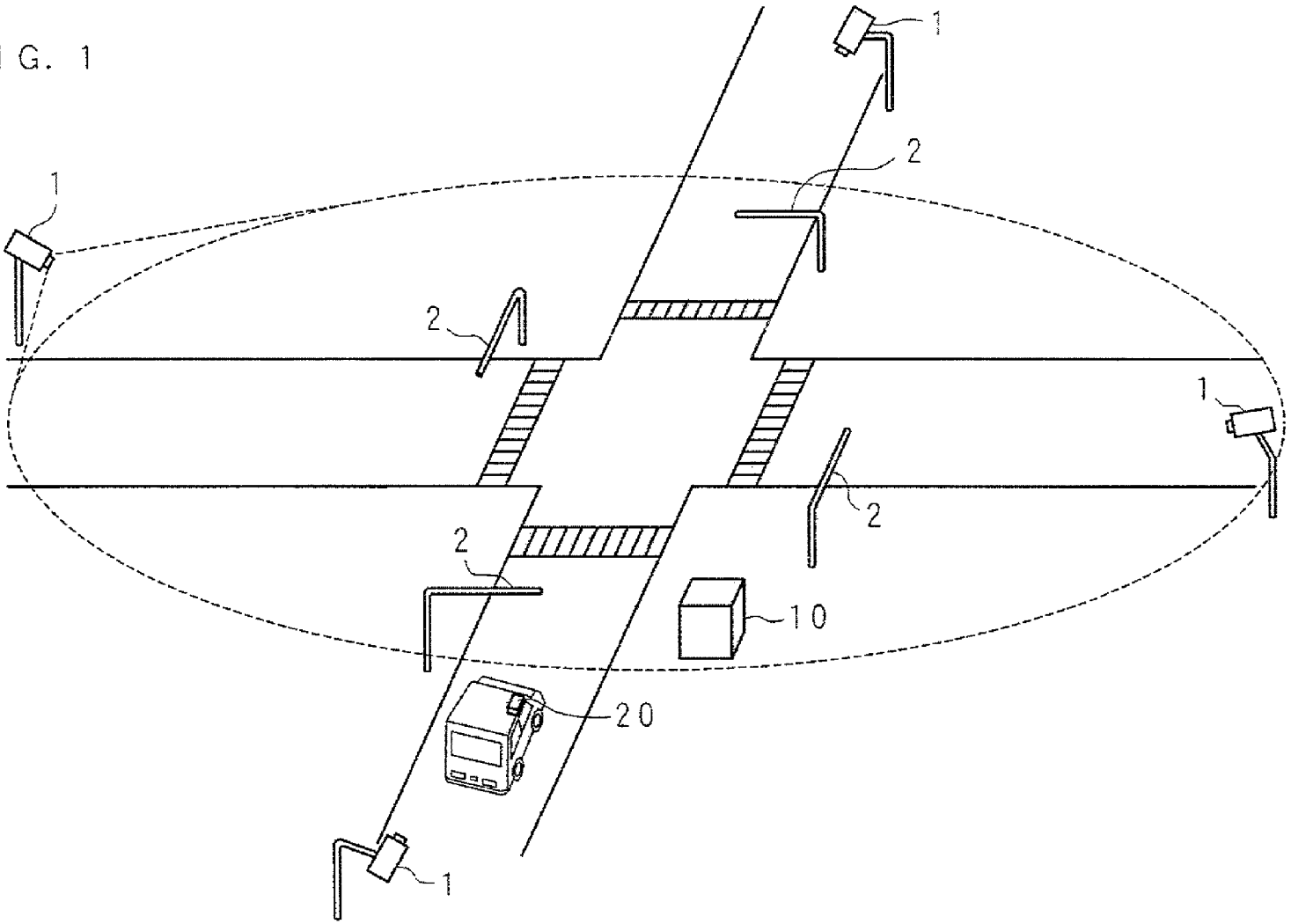
FIG. 1 is a block diagram illustrating an example of a configuration of a traffic situation display system according to the present technique.

The present technique will be described below on the basis of the drawings illustrating the embodiments thereof. FIG. 1 is a block diagram illustrating an example of a configuration of a traffic situation display system according to the present technique. The traffic situation display system according to the present technique includes a road-side device 10, an in-vehicle device 20, and the like. The road-side device 10 is connected with video cameras 1, 1, 1, 1 installed near each road that intersects an intersection to image the direction of the intersection by way of a communication line (not illustrated), where the image data obtained by imaging with each video camera 1 is once outputted to the road-side device 10. The installed location of the video camera 1 is not limited to the example of FIG. 1.

In each road intersecting the intersection, antennas 2, 2, 2, 2 for communicating with the in-vehicle device 20 are arranged on a supporting column standing on the road, and are connected to the road-side device 10 by way of a communication line (not illustrated). In FIG. 1, the road-side device 10, each video camera 1, and each antenna 2 are separately installed, but is not limited thereto, and the video camera 1 may be incorporated in the road-side device 10, the antenna 2 may be incorporated in the road-side device 10, or the road-side device 10 may be in an integrated form incorporating both of the above according to the installed location of the video camera 1.

Figure 2:
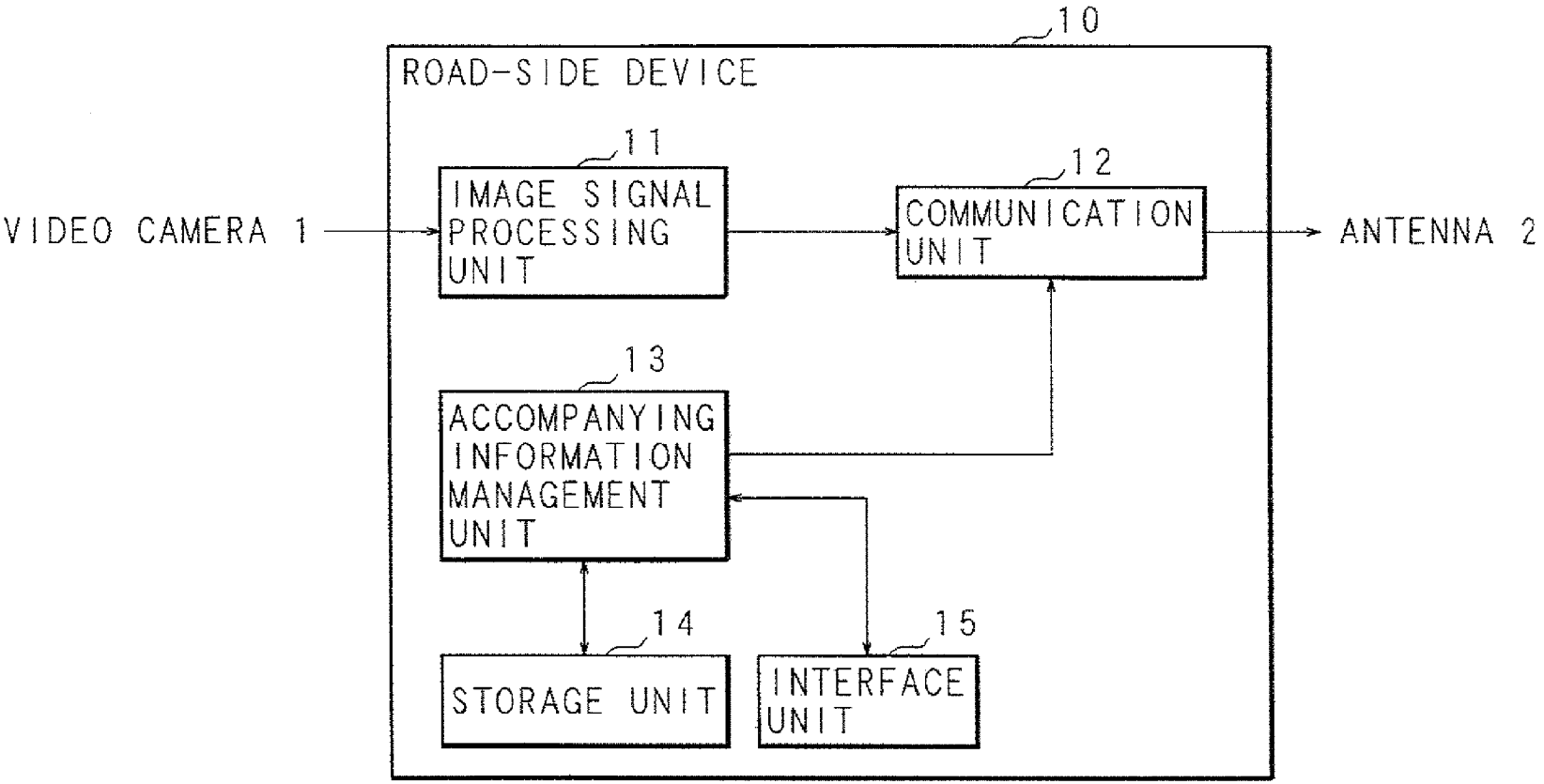
FIG. 2 is a block diagram illustrating an example of a configuration of a road-side device.

FIG. 2 is a block diagram illustrating an example of a configuration of the road-side device 10. The road-side device 10 includes an image signal processing unit 11, a communication unit 12, an accompanying information management unit 13, a storage unit 14, an interface unit 15, and the like.

The image signal processing unit 11 acquires the image data inputted from each video camera 1, and converts the acquired image signal to a digital signal. The image signal processing unit 11 synchronizes the image data converted to the digital signal to a given frame rate (e.g., 30 frames in one second), and outputs an image frame in units of one frame (e.g., 640×480 pixels) to the communication unit 12.

The interface unit 15 has a communicating function for performing communication of data with an installation terminal device 30, to be hereinafter described. The installation terminal device 30 is a device for generating the desired information and storing the same in the storage unit 14 of the road-side device 10 when installing each video camera 1 and the road-side device 10. The interface unit 15 outputs the data inputted from the installation terminal device 30 to the accompanying information management unit 13.

The accompanying information management unit 13 acquires corresponding information, in which a pixel coordinate in the image imaged with each video camera 1 (e.g., pixel position in the image configured by 640×480 pixels) and positional information (e.g., longitude, latitude) of the imaging region imaged with the video camera 1 are corresponded to each other, through the interface unit 15, and stores the acquired corresponding information in the storage unit 14. The accompanying information management unit 13 acquires an identifier identifying each video camera 1 inputted from the interface unit 15 and imaging orientation information indicating an imaging orientation (e.g., east, west, south, north) of each video camera 1, and stores the same in the storage unit 14. The identifier identifies the video camera 1 when the imaging parameters such as lens field angle differ for every video camera 1.

When the image signal processing unit 11 outputs the image obtained by imaging with each video camera 1 to the communication unit 12, the accompanying information management unit 13 outputs the corresponding information, the identifier of each video camera 1, and the imaging orientation information stored in the storage unit 14 to the communication unit 12.

The communication unit 12 acquires the image data inputted from the image signal processing unit 11, as well as the corresponding information, the identifier of each video camera 1, and the imaging orientation information inputted from the accompanying information management unit 13, converts the acquired image data as well as the corresponding information, the identifier of each video camera 1, and the imaging orientation information to data of a given communication format, and transmits the converted data to the in-vehicle device 20 through the antenna 2. The image accompanying information such as the corresponding information, the identifier of each video camera 1, and the imaging orientation information may be transmitted to the in-vehicle device 20 only once at a timing of starting the transmission of image data, or may be transmitted by being included between the image data at a given time interval.

Figure 3:
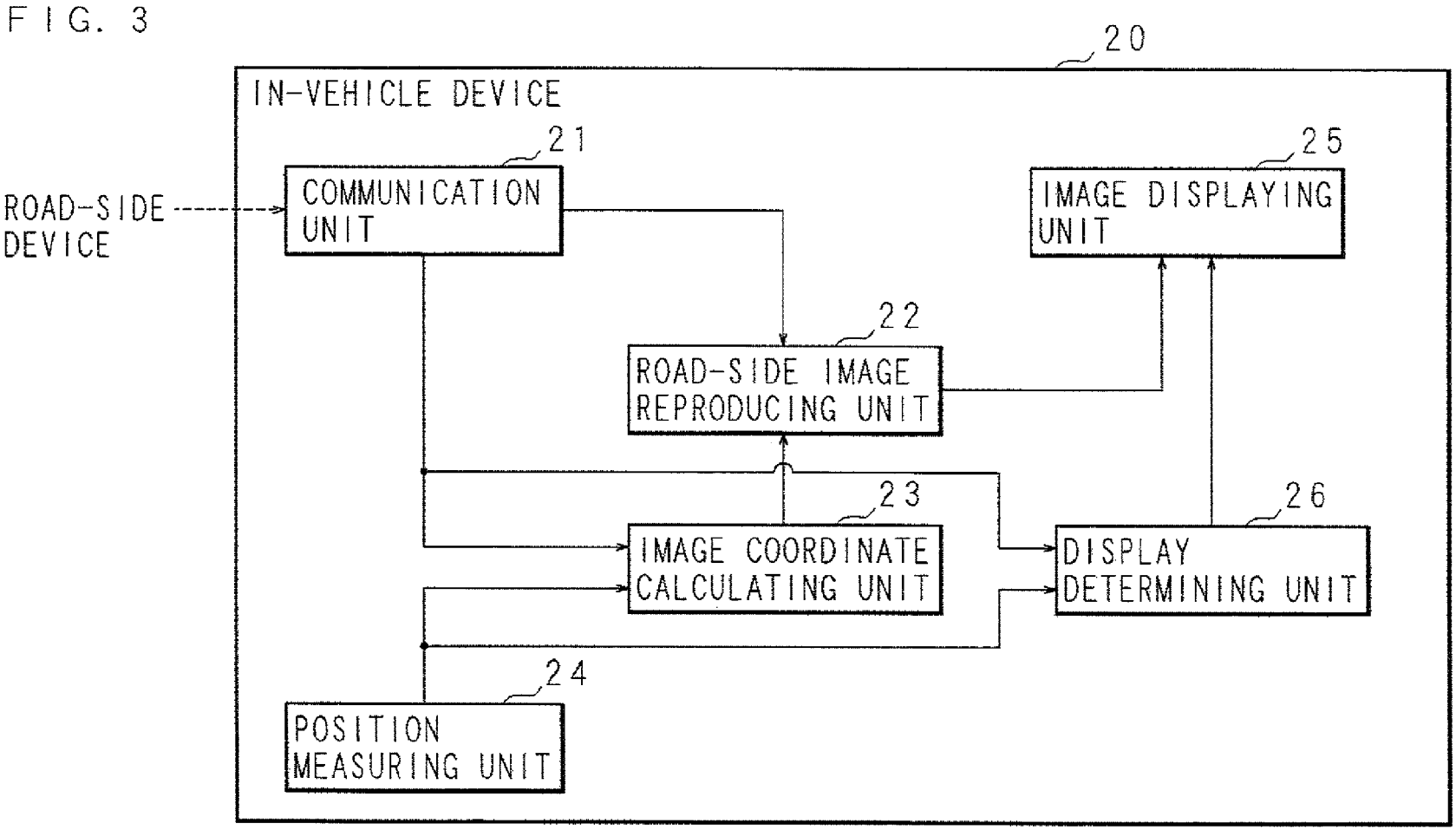
FIG. 3 is a block diagram illustrating an example of a configuration of an in-vehicle device.

FIG. 3 is a block diagram illustrating an example of a configuration of the in-vehicle device 20. The in-vehicle device 20 includes a communication unit 21, a road-side image reproduction unit 22, an image coordinate calculation unit 23, a position measurement unit 24, an image display unit 25, a display determining unit 26, and the like.

The communication unit 21 receives the data transmitted from the road-side device 10, extracts the image data obtained by imaging with each video camera 1 from the received data, extracts the image accompanying information such as the corresponding information, the identifier of each video camera 1, and the imaging orientation information, outputs the extracted image data to the road-side image reproduction unit 22, and outputs the corresponding information, the identifier of each video camera 1, and the imaging orientation information to the image coordinate calculation unit 23 and the display determining unit 26.

The position measurement unit 24 has a GPS function, map information, acceleration sensor function, gyro, and the like, specifies the positional information (e.g., latitude, longitude) of the own vehicle on the basis of vehicle information (e.g., speed etc.) inputted from a vehicle control unit (not illustrated), and outputs the advancing orientation of the vehicle, the specified positional information, and the like to the image coordinate calculation unit 23 and the display determining unit 26. The position measurement unit 24 is not limited to being incorporated in the in-vehicle device 20, and may be substituted with an external device separate from the in-vehicle device 20 such as navigation system, built-in GPS, and mobile telephone.

The image coordinate calculation unit 23 calculates the pixel coordinate on the image corresponding to the positional information of the own vehicle inputted from the position measurement unit 24 on the basis of the corresponding information (information in which the pixel coordinate in the image and the positional information of the imaging region are corresponded to each other) inputted from the communication unit 21. The image coordinate calculation unit 23 determines whether or not the own vehicle position is within the image on the basis of the calculated pixel coordinate, and outputs the calculated pixel coordinate to the road-side image reproduction unit 22 if the own vehicle position is within the image. The image coordinate calculation unit 23 specifies image peripheral position corresponding to the direction of the own vehicle position if the own vehicle position is not within the image, and outputs an image peripheral coordinate to the road-side image reproduction unit 22.

The road-side image reproduction unit 22 has an image signal decoding circuit, on-screen display function, and the like, adds image data illustrating an own vehicle position mark to the image data inputted from the communication unit 21 when the pixel coordinate is inputted from the image coordinate calculation unit 23, performs a process such that the own vehicle position mark is superimposed and displayed on the image, and outputs the processed image data to the image display unit 25. The superimposing and displaying process may be performed in units of image frames or may be performed by decimating by every plural image frames.

When the image peripheral coordinate is inputted from the image coordinate calculation unit 23, the road-side image reproduction unit 22 adds image data illustrating a mark indicating the direction of the own vehicle position and character information notifying that the own vehicle position is outside the image to the image data inputted from the communication unit 21, performs a process of superimposing and displaying the mark indicating the direction of the own vehicle position and the character information on the image periphery, and outputs the processed image data to the image display unit 25.

The display determining unit 26 determines which image imaged with the video camera 1 of the images imaged with each video camera 1 to be displayed on the image display unit 25, and outputs a determining signal to the image display unit 25. More specifically, the display determining unit 26 stores a priority table in which a priority is set to at least one of straight direction, left-turn direction, and right-turn direction. The display determining unit 26 decides the imaging orientation corresponding to the direction with the highest set priority on the basis of the advancing orientation of the own vehicle inputted from the position measurement unit 24 and the imaging orientation information of each video camera 1 inputted from the communication unit 21. For instance, if the highest priority is set to the straight direction, the display determining unit 26 assumes that a situation of the vehicle existing in a region (straight direction) that becomes a blind corner due to other vehicles waiting to make a right turn near the center of the intersection is most important for drivers in terms of traffic safety, and decides the image in which the imaging orientation facing the intersection is "south" or very close to "south" when the advancing orientation of the own vehicle is "north", and outputs the determining signal to display the image of the decided imaging orientation.

Thus, the most suitable image of the images imaged with each video camera 1 can be selected and displayed in accordance with a traveling situation of the vehicle, whereby the road situation that is difficult to check from the driver can be accurately displayed and the position of the own vehicle can be checked on the displayed image, and thus the road situation around the own vehicle can be accurately grasped.

Figure 4:
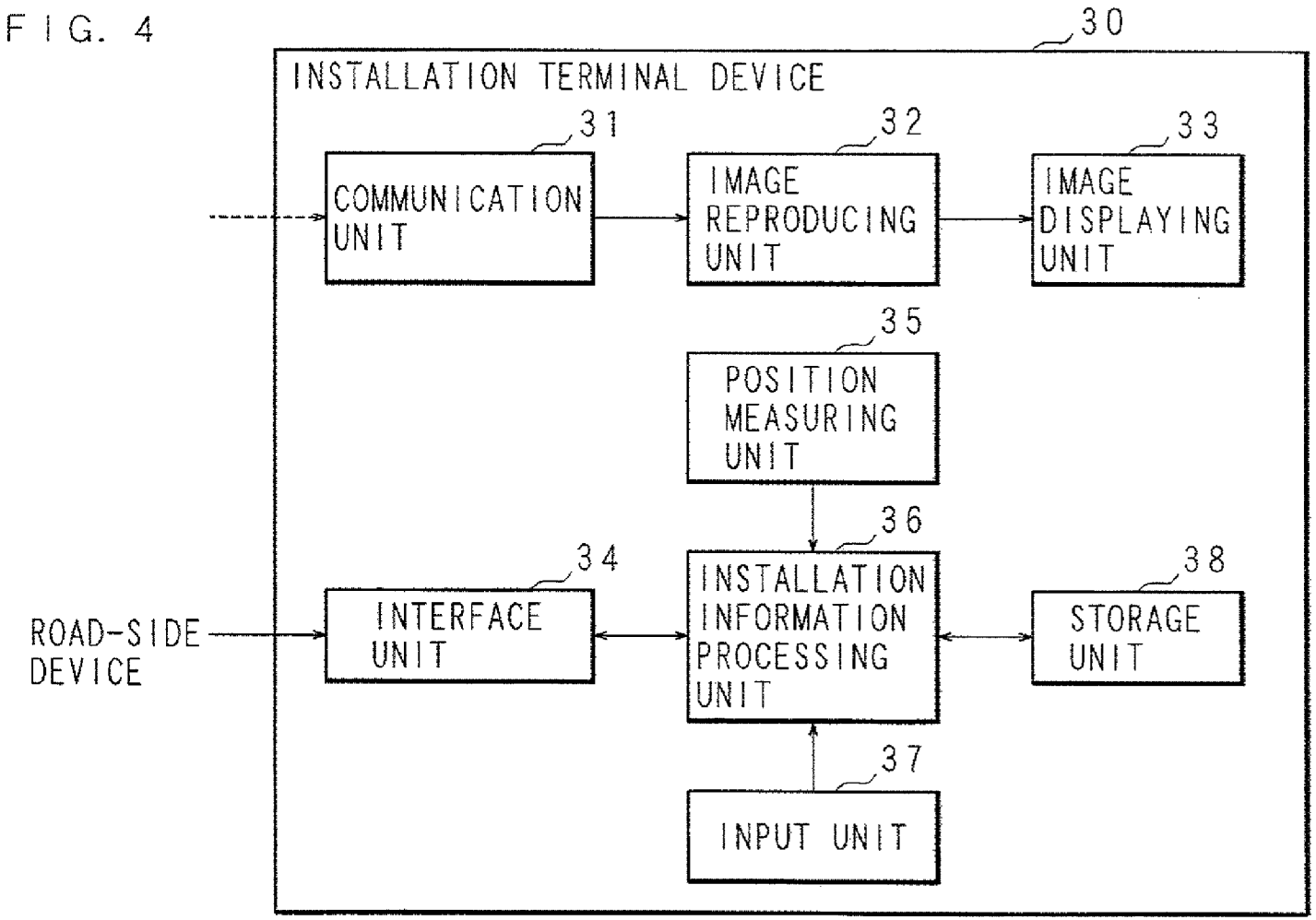
FIG. 4 is a block diagram illustrating an example of a configuration of an installation terminal device.

FIG. 4 is a block diagram illustrating an example of a configuration of the installation terminal device 30. The installation terminal device 30 includes a communication unit 31, an image reproduction unit 32, an image display unit 33, an interface unit 34, a position measurement unit 35, an installation information processing unit 36, an input unit 37, a storage unit 38, and the like. The installation terminal device 30 generates the corresponding information, in which the pixel coordinate in the image imaged with each video camera 1 and the positional information of the imaging region imaged with each video camera 1 are corresponded to each other, according to a installation state when installing each video camera 1 and the road-side device 10 at the desired locations.

The communication unit 31 receives the data transmitted from the road-side device 10, extracts the image data obtained by imaging with each video camera 1 from the received data, and outputs the extracted image data to the image reproduction unit 32.

The image reproduction unit 32 includes an image signal decoding circuit, performs a given decoding process, analog image signal conversion process and the like on the image data inputted from the communication unit 31, and outputs the processed image signal to the image display unit 33.

The image display unit 33 includes a monitor such as liquid crystal display and CRT, and displays the image imaged with each video camera 1 on the basis of the image signal inputted from the image reproduction unit 32. The imaging region of each video camera 1 then can be checked at the installation site.

The input unit 37 includes a keyboard, mouse, and the like, and accepts the installation information (e.g., imaging orientation, installation height, depression angle etc.) of each video camera 1 inputted by the installing personnel and outputs the input installation information to the installation information processing unit 36 when installing each video camera 1.

The position measurement unit 35 has a GPS function, and acquires the positional information (e.g., latitude, longitude) of the location installed with each video camera 1, and outputs the acquired positional information to the installation information processing unit 36.

The interface unit 34 has a communication function for performing communication of data with the road-side device 10. The interface unit 34 acquires various parameters (e.g., model, lens field angle, etc. of each video camera 1) from the road-side device 10, and outputs the acquired various parameters to the installation information processing unit 36.

The storage unit 38 stores preliminary data (e.g., geographical information of the road surrounding, gradient information of the road surface, database by model of video camera, etc.) for calculating the corresponding information.

The installation information processing unit 36 generates the corresponding information, in which the pixel coordinate (e.g., pixel position in the image configured by 640×480 pixels) in the image imaged with each video camera 1 and the positional information (e.g., longitude and latitude) of the imaging region imaged with each video camera 1 are corresponded each other, on the basis of the lens field angle of each video camera 1, the installation information (e.g., imaging orientation, installation height, depression angle, etc.), positional information (e.g., latitude, longitude), preliminary data (e.g., geographical information of the road surrounding, gradient information of the road surface, database by model of video camera, etc.), and outputs the generated corresponding information, the imaging orientation of each video camera 1, and the identifier for identifying each video camera 1 to the road-side device 10 through the interface unit 34. The corresponding information generated through a complex process can be prepared in advance on the basis of various parameters such as the installation position, imaging orientation, field angle of each video camera 1, gradient of the road surface and the like, so that such complex process does not need to be performed in the in-vehicle device 20.

Figure 5:
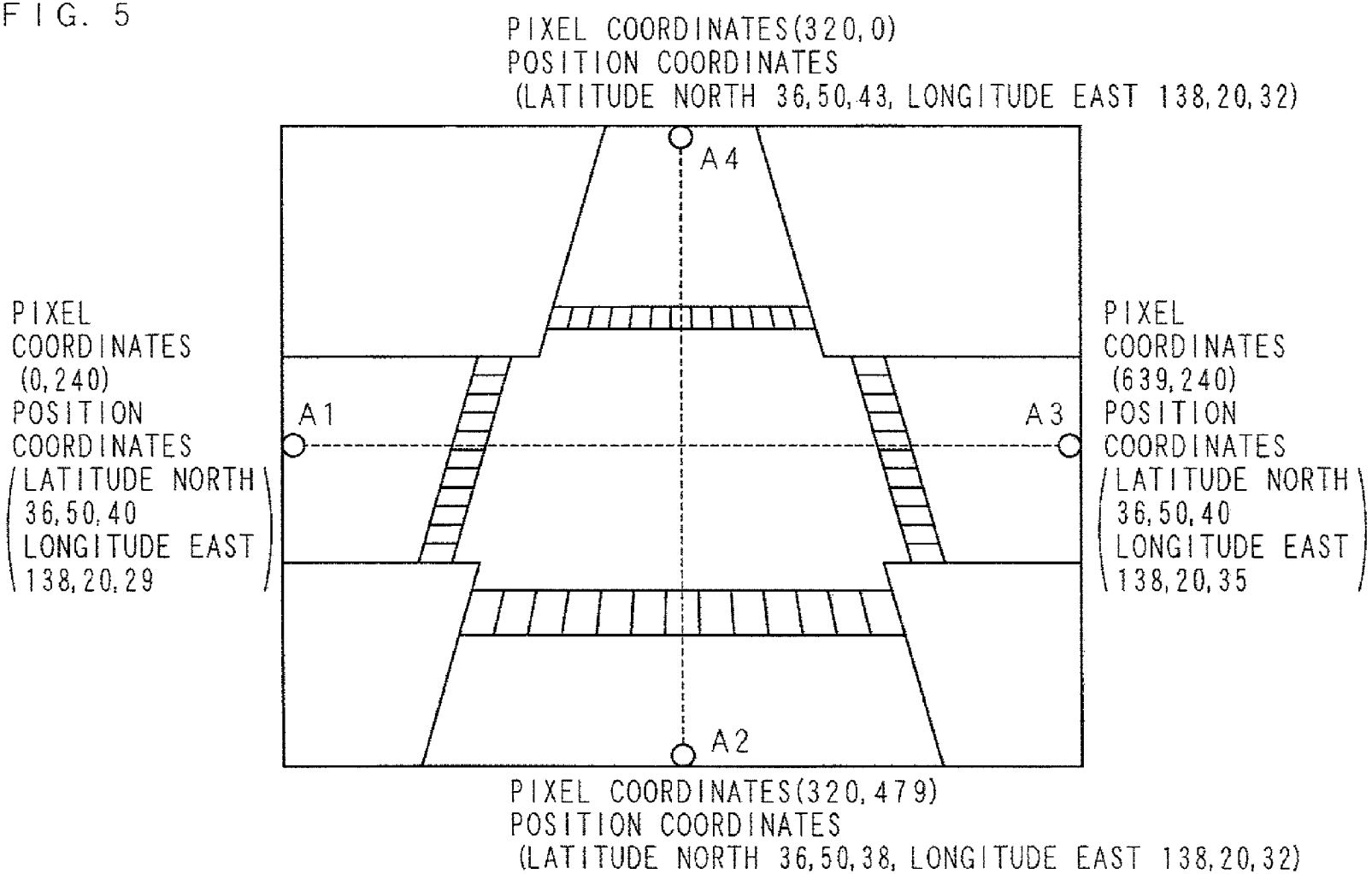
FIG. 5 is an explanatory view illustrating an example of corresponding information.

FIG. 5 is an explanatory view illustrating an example of corresponding information. As illustrated in FIG. 5, the corresponding information is configured by the pixel coordinate and the positional information, and corresponds to the pixel coordinate and the positional information (latitude, longitude) of each four corresponding points (A1, A2, A3, A4) at the central part of each side of the image. In this case, the image coordinate calculation unit 23 of the in-vehicle device 20 can perform interpolation calculation (or linear conversion) and calculate the pixel coordinate at the position of the own vehicle from the positional information (latitude, longitude) of the own vehicle acquired from the position measurement unit 24 and the positional information of the points A1 to A4.

Figure 6:
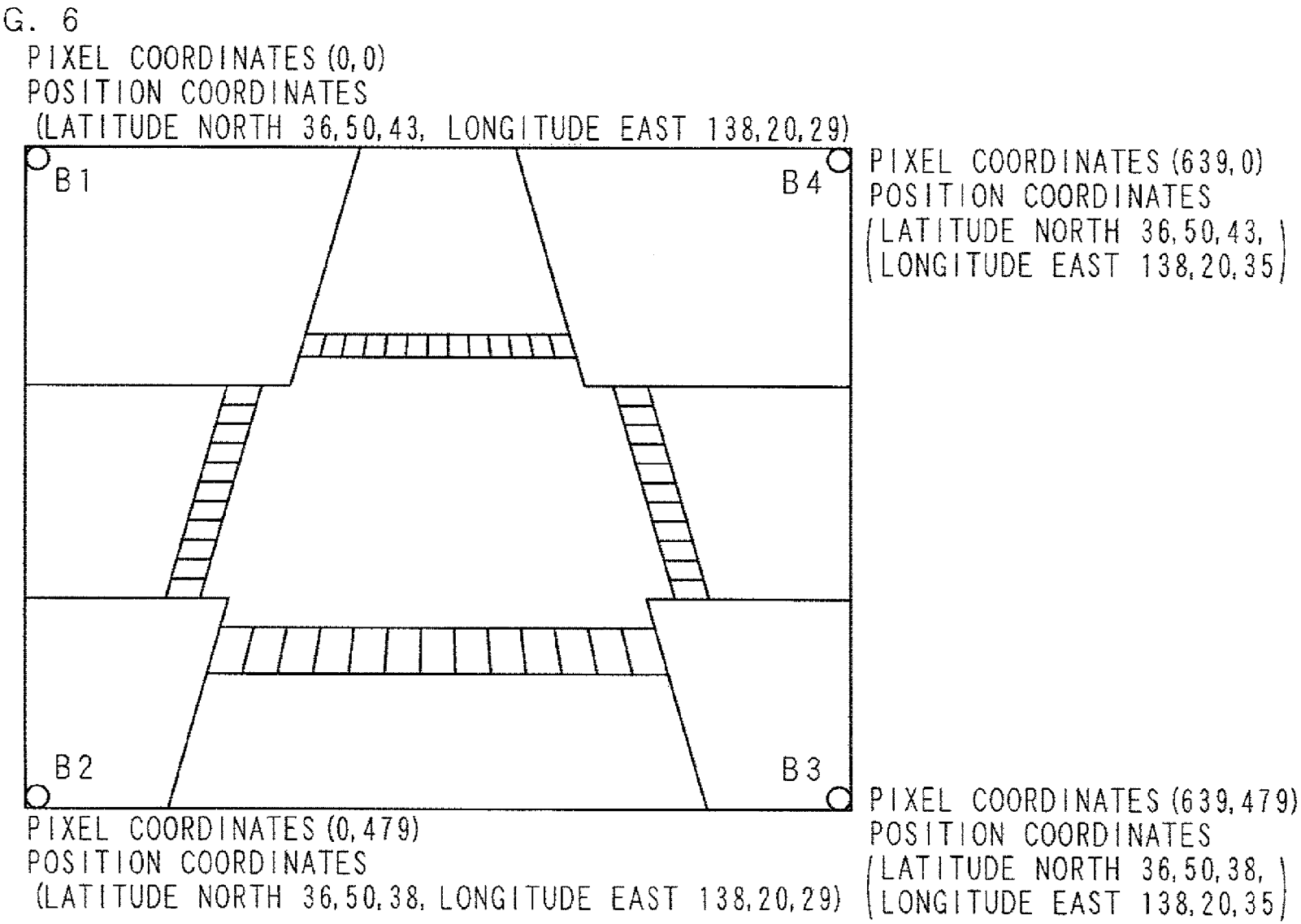
FIG. 6 is an explanatory view illustrating another example of corresponding information.

FIG. 6 is an explanatory view illustrating another example of corresponding information. As illustrated in FIG. 6, the corresponding information corresponds to the pixel coordinate and the positional information (latitude, longitude) of each four corresponding points (B1, B2, B3, B4) of each four corners of the image. In this case, the image coordinate calculation unit 23 of the in-vehicle device 20 can perform interpolation calculation (or linear conversion) and calculate the pixel coordinate at the position of the own vehicle from the positional information (latitude, longitude) of the own vehicle acquired from the position measurement unit 24 and the positional information of the points B1 to B4. The number of corresponding points is not limited to four, and may be two points on the diagonal line of the image.

Figure 7:
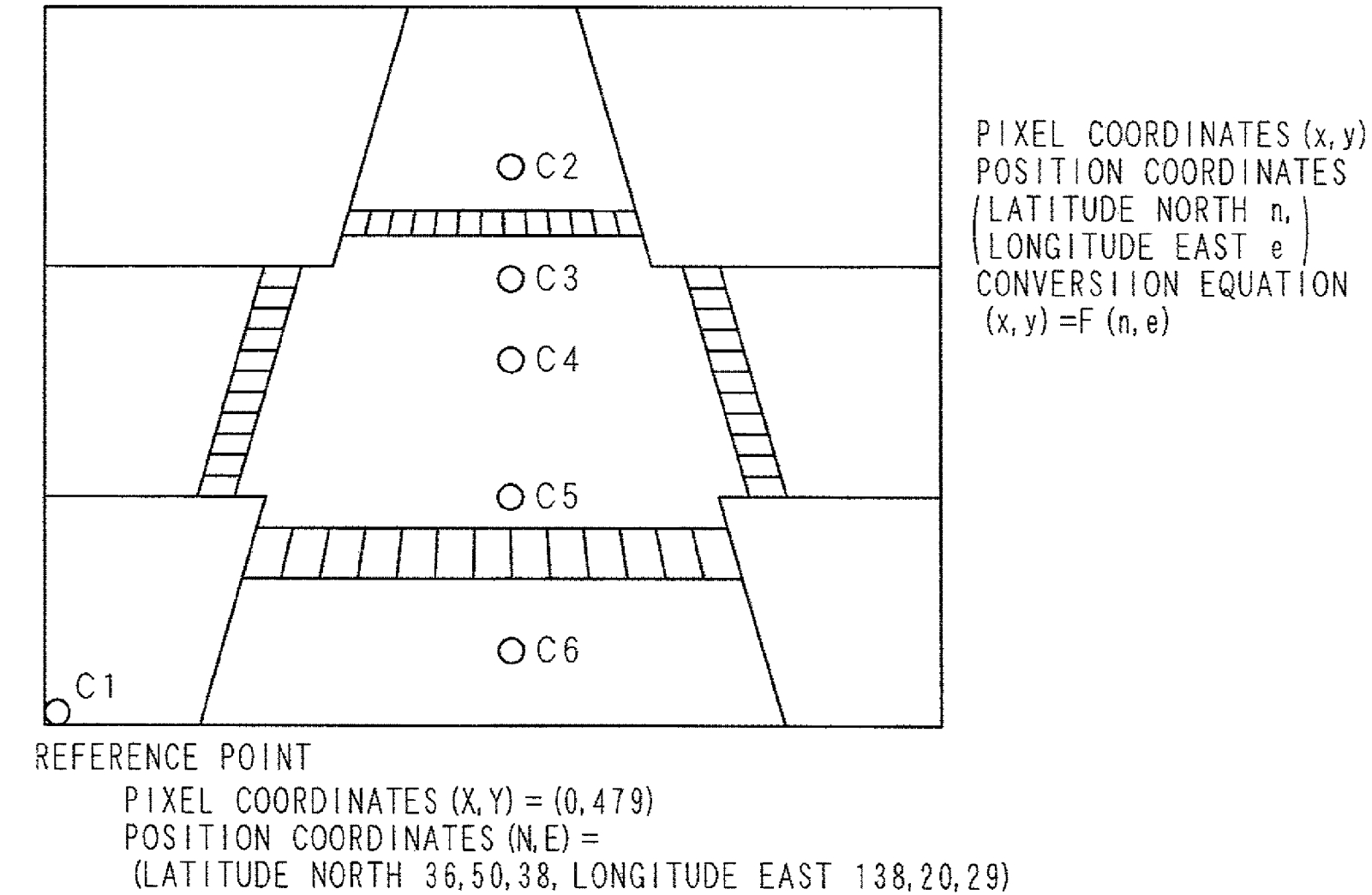
FIG. 7 is an explanatory view illustrating another example of corresponding information.

FIG. 7 is an explanatory view illustrating another example of corresponding information. As illustrated in FIG. 7, the corresponding information is configured by the pixel coordinate, the positional information, and the conversion equation, and corresponds to the pixel coordinate (X, Y) and the positional information (latitude N, longitude E) of a reference point C1 at the lower left of the image. The conversion equation (x, y)=F(n, e) corresponds to the pixel coordinate (x, y) and the positional coordinate (latitude n, longitude e) of an arbitrary point C2, C3, . . . on the image. In this case, the image coordinate calculation unit 23 of the in-vehicle device 20 can calculate the pixel coordinate at the position of the own vehicle by equation (1) and equation (2) on the basis of the positional information (latitude n, longitude e) of the own vehicle acquired from the position measurement unit 24 and the pixel coordinate (X, Y) and the positional coordinate (N, E) of the reference point C1.

$$x(e)=\{a-b\cdot(n-N)\}\cdot(e-E) \quad (1)$$

$$y(n)=Y-c(n-N)^2 \quad (2)$$

In equation (1) and equation (2), a, b, and c are constants defined depending on the lens field angle, the imaging orientation, the installation height, the depression angle, and the installation position of each video camera 1, the gradient of the road surface, and the like.

In this case, the imaging parameters such as the lens field angle, the imaging orientation, the installation height, the depression angle, and the installation position of each video camera 1, the gradient of the road surface, and the like differ for every video camera, and thus the conversion equation for calculating the pixel coordinate of the own vehicle on the image imaged with each video camera 1 differs. The identifier of each video camera 1 and the conversion equation thus can be corresponded to each other.

FIG. 8 is an explanatory view illustrating a relationship of the identifier of the video camera and the conversion equation. As illustrated in FIG. 8, the conversion equation (x, y)=F1(n, e) is used when the identifier of the video camera is "001", and the conversion equation (x, y)=F2(n, e) can be used when the identifier of the video camera is "002". Thus, the own vehicle position can be obtained by selecting the conversion equation most adapted to the installed video camera 1 even if the imaging parameters such as the model, the lens field angle, and the installation conditions of the video camera 1 to be installed on the road are different, whereby the versatility is high and the own vehicle position can be specified at satisfactory accuracy.

FIG. 9 is an explanatory view illustrating another example of corresponding information. As illustrated in FIG. 9, the corresponding information is configured by the pixel coordinate of each pixel on the image and the positional information (latitude, longitude) corresponding to each pixel. In this case, the image coordinate calculation unit 23 of the in-vehicle device 20 can calculate the pixel coordinate at the position of the own vehicle by specifying the pixel coordinate corresponding to the positional information (latitude, longitude) of the own vehicle acquired from the position measurement unit 24.

FIG. 10 is an explanatory view illustrating another example of corresponding information. As illustrated in FIG. 10, the corresponding information is configured by the pixel coordinate corresponding to the positional information (latitude, longitude) of a specific interval on the image. For the specific interval, the pixel coordinate in a case where the latitude and the longitude are changed by one second can be corresponded. In this case, the image coordinate calculation unit 23 of the in-vehicle device 20 can calculate the pixel coordinate at the position of the own vehicle by specifying the pixel coordinate corresponding to the positional information (latitude, longitude) of the own vehicle acquired from the position measurement unit 24.

As described above, the corresponding information may have various types of formats, and any one of the corresponding information may be used. The corresponding information is not limited thereto, and other formats may be used.

An example of which image data imaged with the video camera 1 to be employed when the in-vehicle device 20 receives the image data imaged with each video camera 1 from the road-side device 10 will now be described.

Figure 11:
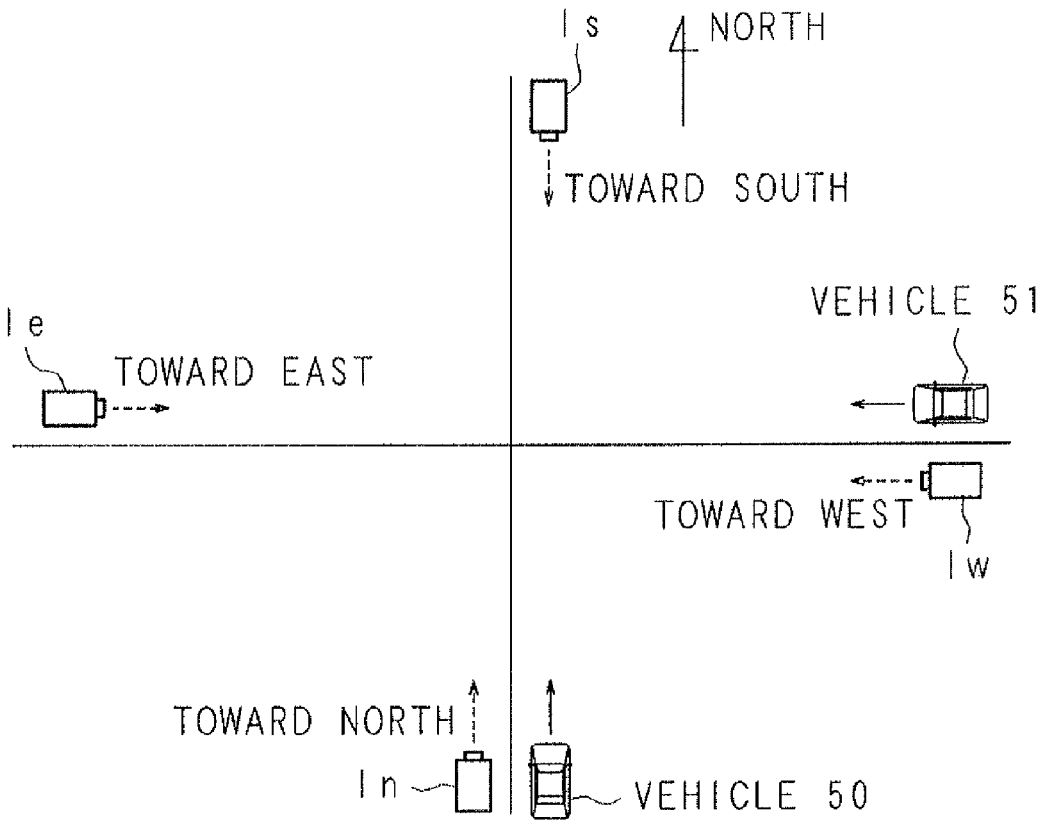
FIG. 11 is an explanatory view illustrating a selection method of the video camera.

FIG. 11 is an explanatory view illustrating a selection method of the video camera, and FIG. 12 is an explanatory view illustrating an example of a priority table for selecting the video camera. As illustrated in FIG. 11, video cameras 1*e*, 1*n*, 1*w*, 1*s* for imaging the direction of the intersection are respectively installed on each road running north, south, east, and west intersecting the intersection. The direction of each road is not limited to north, south, east, and west, but is assumed as north, south, east, and west to simplify the explanation. The imaging orientation of each video camera 1*e*, 1*n*, 1*w*, and 1*s* is east, north, west, and south. Each vehicle 50, 51 is running north and west, respectively, towards the intersection.

As illustrated in FIGS. 12A to 12D, the priority table defines the priority (1, 2, 3, etc.) of the monitoring direction (e.g., straight direction, left-turn direction, right-turn direction, etc.) necessary for the driver. The priority may be set for one monitoring direction. In the case of the vehicle 50 of FIG. 12A and FIG. 12B, the monitoring direction having the highest priority is set to the straight direction. This is assumed as a case where the situation of the vehicle existing in a region (straight direction) that becomes a blind corner due to another vehicle waiting to make a right turn near the middle of the intersection is the most important in terms of traffic safety for the driver when making a right turn at the intersection. If the advancing orientation of the own vehicle (vehicle) 50 is "north", as illustrated in FIG. 11, the image in which the imaging orientation facing the intersection is "south" or very close to "south" can be selected. The priority may be set by the driver, or may be set according to the traveling situation (e.g., in conjunction with right, left turn signals) of the vehicle.

Furthermore, in the case of the vehicle 51 of FIG. 12C and FIG. 12D, the monitoring direction having the highest priority is set to the right-turn direction. This is assumed to be a case where the situation of the other vehicle approaching from the road on the right side at the intersection is the most important in terms of traffic safety for the driver. If the advancing orientation of the own vehicle (vehicle) 51 is "west", as illustrated in FIG. 11, the image in which the imaging orientation facing the intersection is "south" or very close "south" can be selected. Therefore, the most suitable image can be selected and displayed in accordance with the traveling situation of the vehicle, the road situation difficult to check from the driver can be accurately displayed, the position of the own vehicle can be checked on the displayed image, and the road situation around the own vehicle can be accurately grasped.

Figure 13:
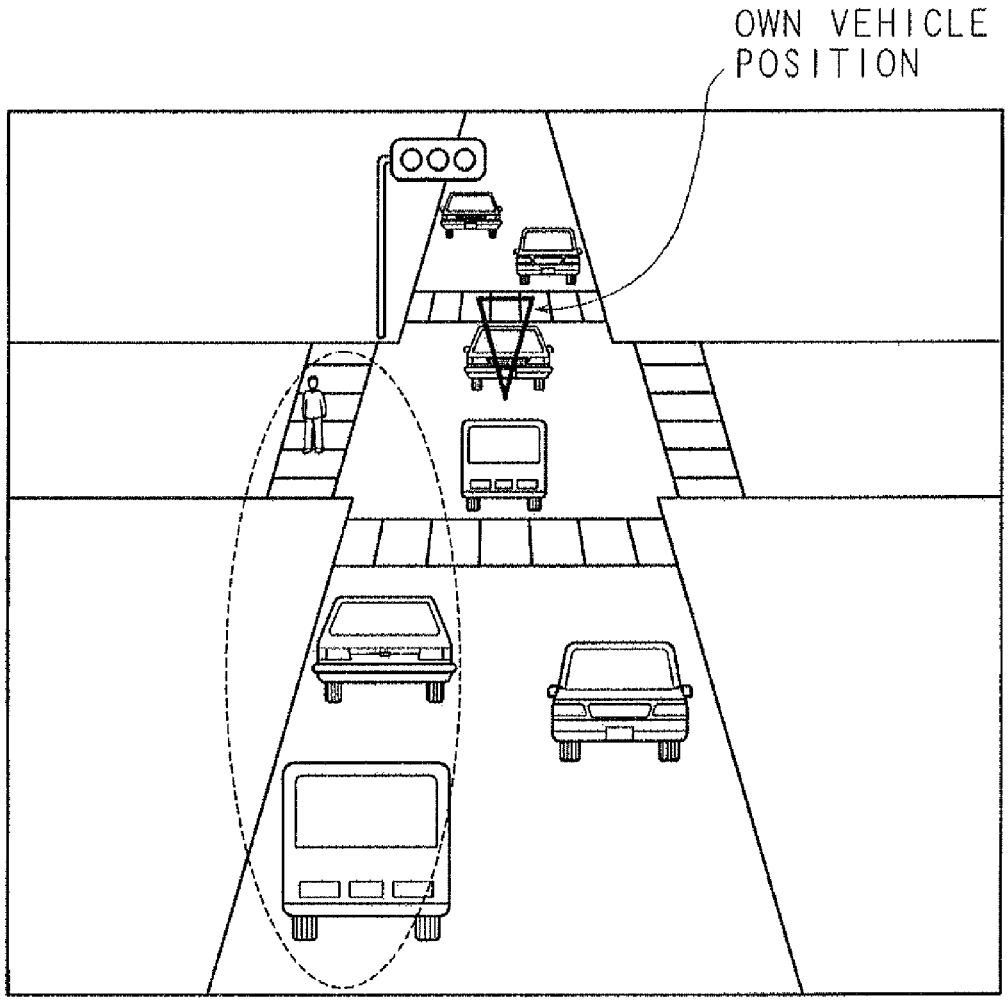
FIG. 13 is an explanatory view illustrating a display example of the own vehicle position mark.

FIG. 13 is an explanatory view illustrating a display example of an own vehicle position mark. As illustrated in FIG. 13, the image displayed on the image display unit 25 of the in-vehicle device 20 is an image imaged towards the intersection with the video camera 1 installed on the front side in the advancing direction of the own vehicle. The mark of the own vehicle position is a graphic symbol of an isosceles triangle, where the vertex direction of the isosceles triangle represents the advancing direction of the own vehicle. The mark of the own vehicle position is an example, and is not limited thereto, and may be any type such as arrow, symbol or pattern as long as the position and the advancing direction of the own vehicle can be clearly recognized, and the mark may be highlight displayed, flash displayed, or color displayed having identification ability. In the case of FIG. 13, it is extremely useful in avoiding collision with a straight advancing vehicle at the intersection where the oncoming vehicle cannot be seen due to the opposing vehicle waiting to make a right turn in time of right turn.

Figure 14:
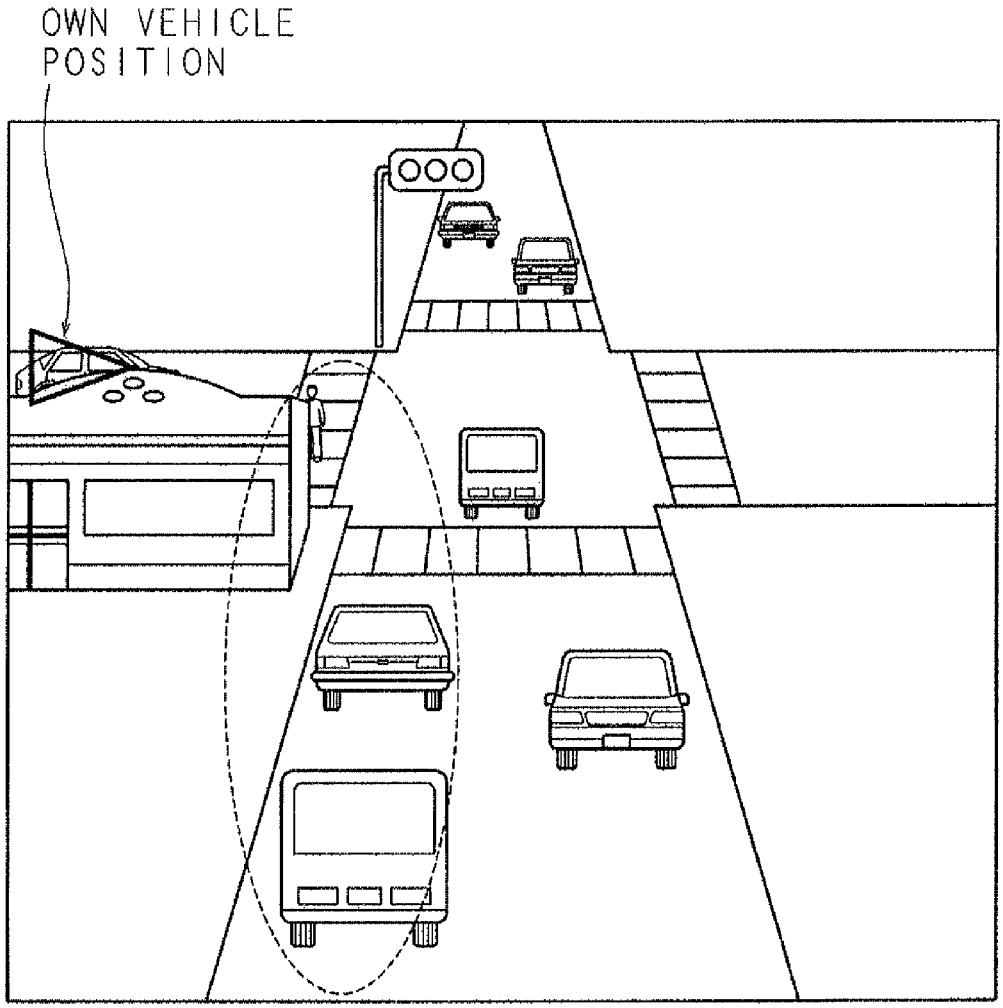
FIG. 14 is an explanatory view illustrating a display example of own vehicle position mark.

FIG. 14 is an explanatory view illustrating a display example of the own vehicle position mark. As illustrated in FIG. 14, the image displayed on the image display unit 25 of the in-vehicle device 20 is an image imaged towards the intersection with the video camera 1 installed in the right-turn direction of the own vehicle. In the case of FIG. 14, it is extremely useful in avoiding head-to-head collision when entering a road with great traffic.

Figure 15:
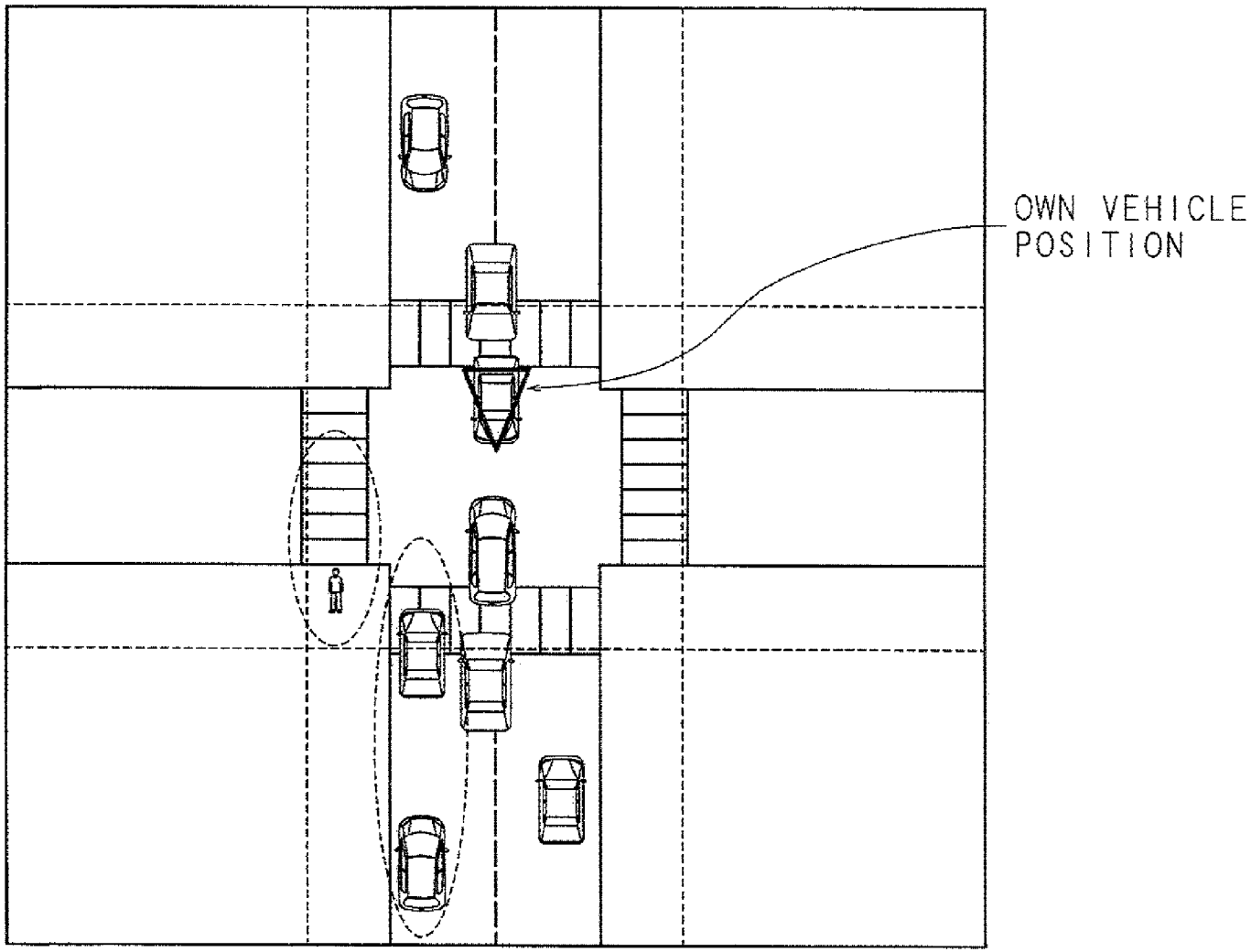
FIG. 15 is an explanatory view illustrating another image example.

FIG. 15 is an explanatory view illustrating another image example. The example illustrated in FIG. 15 is a case of performing the conversion and bonding process on the image imaged with each video camera 1 at the road-side device 10, and transmitting the same as one synthetic image to the in-vehicle device 20. In this case, the conversion and bonding process of the four images is performed in the image signal processing unit 11. As illustrated in FIG. 15, the image displayed on the image display unit 25 of the in-vehicle device 20 is an image imaged towards the intersection with the video camera 1 installed on the front side in the advancing direction of the own vehicle. The mark of the own vehicle position is a graphic symbol of an isosceles triangle, where the vertex direction of the isosceles triangle represents the advancing direction of the own vehicle. In the case of FIG. 15, the position of the own vehicle and the whole picture of the vicinity of the intersection are clarified, whereby head-on collision, head-to-head collision, and the like can be avoided.

Figure 16:
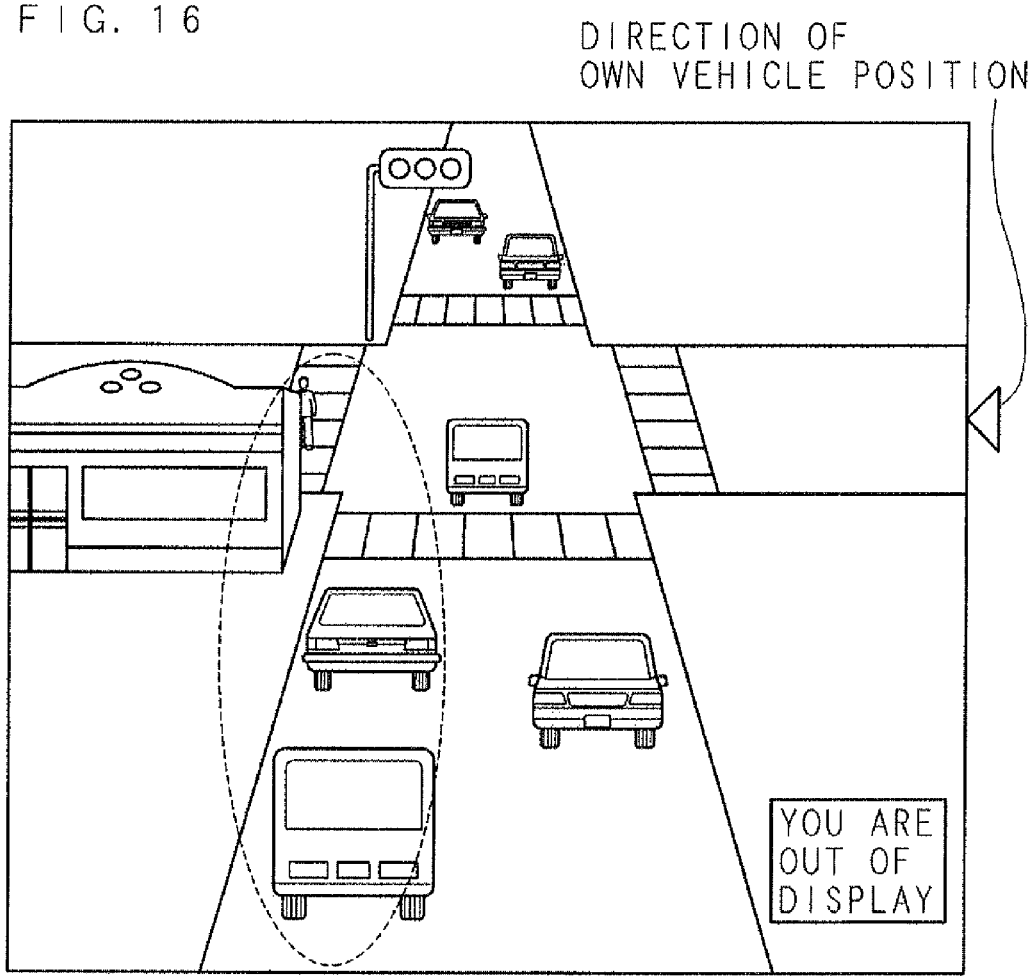
FIG. 16 is an explanatory view illustrating a display example of the own vehicle position mark outside the image.

FIG. 16 is an explanatory view illustrating a display example of the own vehicle position mark outside the image. If determined that the own vehicle is not in the imaging region, the image displayed on the image display unit 25 of the in-vehicle device 20 displays the direction the own vehicle exists at the periphery of the image. Thus, the driver can easily judge the direction the own vehicle exists even if the own vehicle position is outside the image, and the road situation around the own vehicle can be grasped beforehand. The character information (e.g., "out of screen") indicating that the own vehicle is not in the image can be displayed. The driver can then instantly judge that the own vehicle is not displayed, thereby preventing the attention from being diverted by the image being displayed.

Figure 17:
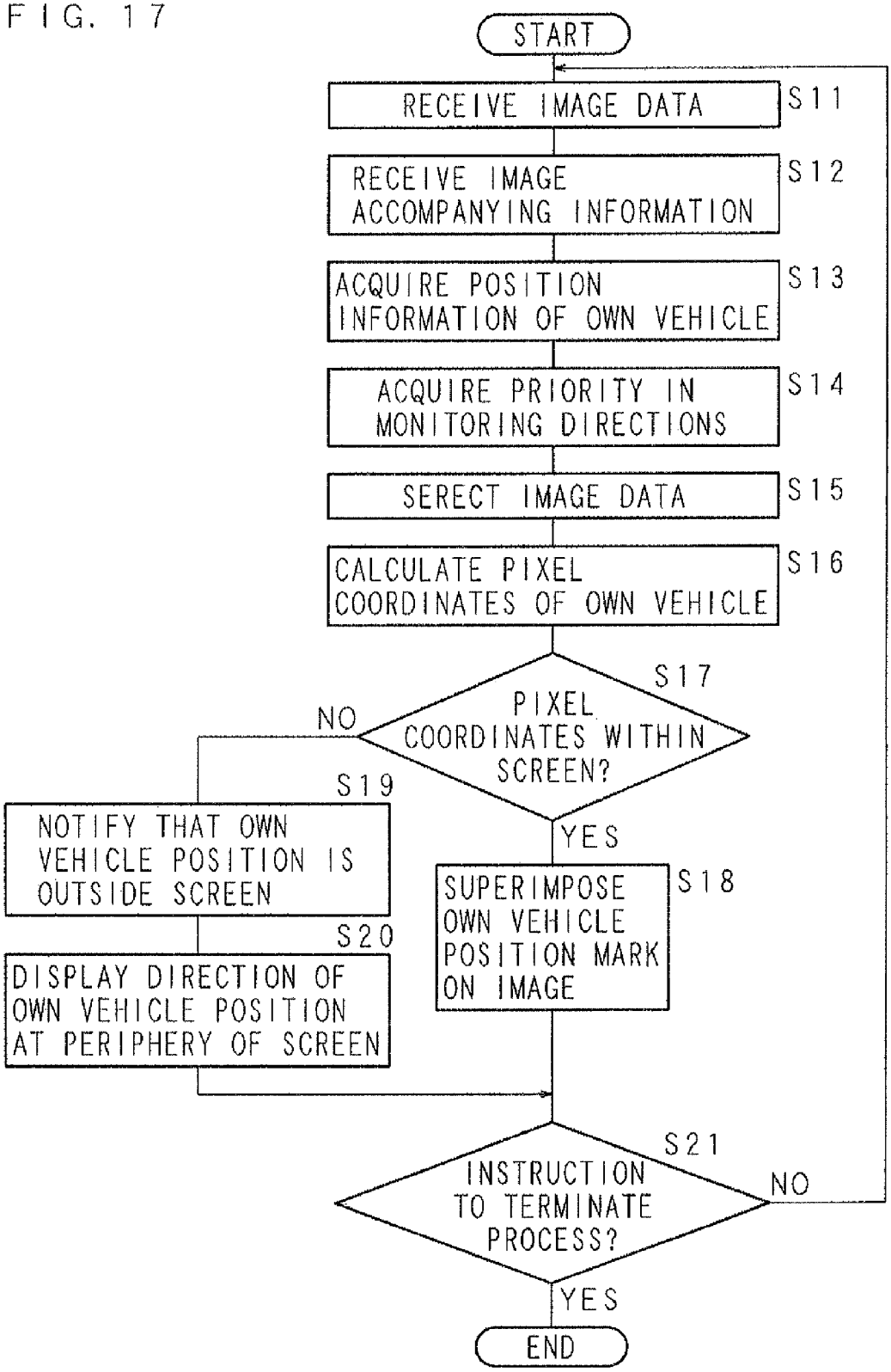
FIG. 17 is a flowchart illustrating a process of displaying the own vehicle position.

The operation of the in-vehicle device 20 will now be described. FIG. 17 is a flowchart illustrating a process of displaying the own vehicle position. The process of displaying the own vehicle position is not only configured by a dedicated hardware circuit in the in-vehicle device 20, but also configured with a microprocessor including CPU, RAM, ROM, computer-readable medium and the like, and may be performed by loading the program code defining the procedure of the process of displaying the own vehicle position in the RAM, and executing the program code with the CPU.

The in-vehicle device 20 receives image data (at S11), and receives image accompanying information (at S12). The in-vehicle device 20 acquires the positional information of the own vehicle in the position measurement unit 24 (at S13), and acquires the priority in the monitoring direction from the priority table stored in the display determining unit 26 (at S14).

The in-vehicle device 20 selects the image data (video camera) to be displayed on the basis of the acquired priority and the advancing orientation of the own vehicle (at S15). The in-vehicle device 20 calculates the pixel coordinate of the own vehicle on the basis of the acquired positional information of the own vehicle and the corresponding information contained in the image accompanying information (at S16). When calculating the pixel coordinate using the conversion equation, the conversion equation corresponding to the identifier of the selected video camera 1 is selected.

The in-vehicle device 20 determines whether or not the calculated pixel coordinate is within the screen (within the image) (at S17), and superimposes and displays the own vehicle position mark on the image (at S18) if the pixel coordinate is within the screen (YES in S17). If the pixel coordinate is not within the screen (NO in S17), the in-vehicle device 20 notifies that the own vehicle position is outside the screen (at S19), and displays the direction of the own vehicle position at the periphery of the screen (around the image) (at S20).

The in-vehicle device 20 then determines on the presence of instruction to terminate the process (at S21), and continues the processes after step S11 if the instruction to terminate the process is not made (NO in S21), and terminates the process if the instruction to terminate the process is made (YES in S21).

As described above, in the present technique, the own vehicle position can be displayed on the image and the safety of traffic can be enhanced even with the low cost in-vehicle device with simple function. Furthermore, since the own vehicle position can be obtained by selecting the conversion equation most adapted to the installed video camera, the versatility is high, and the own vehicle position can be specified at satisfactory accuracy. The imaging region that becomes the blind corner to the driver can be displayed and where the own vehicle is located in the imaging region can be instantly judged. Moreover, the road situation around the own vehicle can be accurately grasped. Which portion of the image the imaging region on the front side in the advancing direction of the own vehicle is can be immediately determined, whereby the safety can be further enhanced. The diversion of attention by the image being displayed can be prevented. Furthermore, the road situation around the own vehicle can be grasped beforehand.

In the above-described embodiment, each video camera is installed on each road intersecting the intersection so as to image the direction of the intersection, but the installation method of the video camera is not limited thereto. The number of roads to image with the video camera, the imaging orientation, and the like can be appropriately set.

In the above-described embodiment, the number of pixels of the video camera and the image display unit is 640×480 pixels by way of example, but is not limited thereto, and may be other number of pixels. If the number of pixels of the video camera and the number of pixels of the image display unit are different, the conversion process of the number of pixels (e.g., enlargement, reduction process of image etc.) may be performed in the in-vehicle device or may be performed in the road-side device.

In the above-described embodiment, the road-side device and the video camera are configured as separate devices, but is not limited thereto, and the video camera may be incorporated in the road-side device if one video camera is to be installed.

Various methods such as optical beacon, electric wave beacon, DSRC, wireless LAN, FM multiple broadcasting, mobile telephone and the like may be adopted for the communication between the road-side device and the in-vehicle device.

In the first aspect, the second aspect, the third aspect, and the tenth aspect, a road-side device stores in advance corresponding information, in which a pixel coordinate in the image and positional information of the imaging region are corresponded to each other, and transmits the stored corresponding information to the in-vehicle device along with the image data obtained by imaging the imaging region including roads. The in-vehicle device receives the image data and the corresponding information transmitted by a transmission device. The in-vehicle device acquires positional information of an own vehicle from navigation, GPS, and the like, obtains the pixel coordinate corresponding to the positional information of the own vehicle from the acquired positional information and the positional information of the imaging region contained in the corresponding information, and specifies the obtained pixel coordinate as the own vehicle position on the image. The in-vehicle device displays the specified own vehicle position on the image. When displaying the own vehicle position, the symbol, the pattern, the mark and the like indicating the own vehicle position can be superimposed and displayed on the image being displayed. Therefore, in the in-vehicle device, a complex process of calculating the own vehicle position on the image on the basis of various parameters such as the installation position, the direction, the field angle of the imaging device, and the gradient of the road surface does not need to be performed, and the own vehicle position on the image can be specified simply on the basis of the acquired positional information of the own vehicle and the corresponding information, whereby the safety of traffic can be enhanced even in the low cost in-vehicle device having a simple function.

When displaying the own vehicle position on the image imaged in the road-side device, this can be realized by performing synthesis display of the road-side image imaged in the road-side device and the navigation image obtained in the navigation system, but in this case, the synthesis process of the images needs to be performed after performing multiple image processing such as distortion correction, conversion to the overhead image, rotation process of the image, reduction/enlargement process of the image and the like to match the display format of the road-side image and the navigation image, whereby an expensive in-vehicle device having a high-performance image processing and synthesis display processing function becomes essential, and such expensive in-vehicle device becomes difficult to be mounted on a low priced vehicles such as light automobiles. According to the present invention, the own vehicle position can be displayed on the image imaged in the road-side device even if not using the high-performance, high-function, and expensive in-vehicle device.

In the fourth aspect, the in-vehicle device is stored with the conversion equation for converting the positional information of the own vehicle to the own vehicle position on the image on the basis of the corresponding information in correspondence to the identifier for identifying the imaging device that acquired the image data. The in-vehicle device receives the image data transmitted by the road-side device and the identifier for identifying the imaging device, selects the conversion equation corresponding to the received identifier, and specifies the own vehicle position on the image on the basis of the selected conversion equation and the received corresponding information. The own vehicle position can be obtained by selecting the conversion equation most adapted to the installed imaging device even if the imaging parameters such as the model and the lens field angle of the imaging device installed on the road are different, whereby high versatility is obtained and the own vehicle position can be specified at satisfactory accuracy.

In the fifth aspect, the imaging device for imaging the direction of the intersection is installed in plurals on each road intersecting the intersection, where the road-side device transmits to the in-vehicle device the image data of different imaging orientations imaged with each imaging device and the imaging orientation information on the basis of the installed location of each imaging device. Detection part detects the advancing orientation of the own vehicle, and selection part selects the image to be displayed on the basis of the detected advancing orientation and the received imaging orientation information. Thus, the image data that is the most important can be selected according to the advancing direction of the own vehicle from the image data imaged from different directions on the road (e.g., near intersection), whereby the imaging region that becomes the blind corner to the driver can be displayed and a position where the own vehicle exists in the imaging region can be instantly judged.

In the sixth aspect, setting part sets a priority to at least one of a straight direction, a left-turn direction, and a right-turn direction of the own vehicle. The priority may be set by the driver, or may be set according to the traveling situation (e.g., in conjunction with right, left turn signals) of the vehicle. Decision part decides the imaging orientation corresponding to a direction with highest set priority on the basis of the detected advancing orientation of the own vehicle. The selection part selects the image of the determined imaging orientation. For instance, when the highest priority is set to the straight direction, if the situation of the vehicle existing in the region (straight direction) that becomes the blind corner due to another vehicle waiting to make a right turn near the middle of the intersection is the most important in terms of traffic safety for the driver when making a right turn at the intersection, the image in which the imaging orientation facing the intersection is "south" or very close to "south" is selected when the advancing orientation of the own vehicle is "north". Thus, the most suitable image can be selected and displayed in accordance with the traveling situation of the vehicle, the road situation that is difficult to check from the driver can be accurately displayed, the position of the own vehicle can be checked on the displayed image, and the road situation around the own vehicle can be accurately grasped.

In the seventh aspect, displaying part displays the detected advancing direction of the own vehicle. Thus, which portion of the image the imaging region on the front side of the own vehicle is can be immediately determined, whereby the safety can be further enhanced.

In the eight aspect, determining part determines whether or not the own vehicle exists in the imaging region on the basis of the positional information contained in the received corresponding information and the acquired positional information. Notifying part makes a notification when determined that the own vehicle is not in the imaging region. The driver can instantly judge that the own vehicle is not displayed by notifying that the own vehicle position is outside the image, thereby preventing the attention from being diverted by the image being displayed.

In the ninth aspect, the determining part determines whether or not the own vehicle exists in the imaging region on the basis of the positional information contained in the received corresponding information and the acquired positional information. The displaying part displays a direction the own vehicle exists at the periphery of the image when determined that the own vehicle does not exist in the imaging region. The driver then can easily judge the direction the own vehicle exists and can grasp the road situation around the own vehicle beforehand even if the own vehicle position is outside the image.

In the first aspect, the second aspect, the third aspect, and the tenth aspect, the own vehicle position can be displayed on the image and the safety of traffic can be enhanced even in the low cost in-vehicle device having a simple function.

In the fourth aspect, the own vehicle position can be obtained by selecting the conversion equation most adapted to the installed imaging device, whereby high versatility is obtained and the own vehicle position can be specified at satisfactory accuracy.

In the fifth aspect, the imaging region that becomes the blind corner to the driver can be displayed and the position where the own vehicle exists in the imaging region can be instantly judged.

In the sixth aspect, the road situation around the own vehicle can be accurately grasped.

In the seventh aspect, which portion of the image the imaging region on the front of the own vehicle is can be immediately determined, whereby the safety can be further enhanced.

In the eighth aspect, the attention is prevented from being diverted by the image being displayed.

In the ninth aspect, the road situation around the own vehicle can be grasped beforehand.

All examples and conditional language recited herein are intended for pedagogical purposes to aid the reader in understanding the invention and the concepts contributed by the inventor to furthering the art, and are to be construed as being without limitation to such For example recited examples and conditions, nor does the organization of such examples in the specification relate to a showing of the superiority and inferiority of the invention. Although the embodiments of the present inventions have been described in detail, it may be understood that the various changes, substitutions, and alterations could be made hereto without departing from the spirit and scope of the invention and the scope of which is defined in the claims and their equivalents.

What is claimed is:

1. A traffic situation display method for displaying a traffic situation in a traffic situation display system, the method comprising:

transmitting image data obtained by imaging an imaging region including roads from a road-side device and imaging orientation information identifying the imaging orientation of the road-side device;

receiving image data of different imaging orientations and the imaging orientation information, in an in-vehicle device;

detecting an advancing orientation of a vehicle in which the in-vehicle device is mounted;

selecting an image to be displayed on the basis of the detected advancing orientation and the received imaging orientation information;

displaying, by the in-vehicle device, the selected the image;

storing, by the road-side device, corresponding information in which a pixel coordinate in the image and positional information of the imaging region are corresponded to each other;

transmitting, by the road-side device, the stored corresponding information;

receiving, by the in-vehicle device, the corresponding information;

acquiring, by the in-vehicle device, positional information of an own vehicle;

specifying, by the in-vehicle device, an own vehicle position on the image on the basis of the received corresponding information and the acquired positional information; and displaying, by the in-vehicle device, the specified own vehicle position on the image.

2. A traffic situation display system comprising:

a road-side device transmitting image data obtained by imaging an imaging region including roads; and an in-vehicle device receiving the image data transmitted by the road-side device, wherein the traffic situation display system displays an image on the basis of the image data received by the in-vehicle device, the road-side device includes:

a storage storing corresponding information in which a pixel coordinate in the image and positional information of the imaging region are corresponded to each other; and a transmission part transmitting the corresponding information stored in the storage and an imaging orientation information identifying the imaging orientation of the road-side device, and the in-vehicle device includes:

a receiving part receiving the corresponding information and the imaging orientation information transmitted by the road-side device;

an acquiring part acquiring positional information of an own vehicle, a specifying part specifying an own vehicle position on the image on the basis of the corresponding information received by the receiving part and the positional information acquired by the acquiring part, a detecting part detecting an advancing orientation of the own vehicle, by the in vehicle device, a selecting part selecting an image data for an image to be displayed on the basis of the advancing orientation detected by the detection part and the imaging orientation information received by the receiving part, a displaying part displaying the image, for which the image data is selected by the selecting part, and the own vehicle position specified by the specifying part on the image.

3. An in-vehicle device connectable to a display device, for receiving image data obtained by imaging an imaging region including roads, and displaying an image on the basis of the received image data, the in-vehicle device comprising:

an acquiring part acquiring positional information of an own vehicle;

a receiving part receiving imaging orientation information identifying the imaging orientation of a road-side device with image data of different imaging orientation and corresponding information in which pixel coordinates in the image transmitted by a road-side device and the positional information acquired by the an acquiring part of the imaging region are associated with each other, an acquiring part acquiring positional information of an own vehicle;

a specifying part specifying an own vehicle position on the image on the basis of the corresponding information received by the receiving part and the positional information acquired by the acquiring part;

a detecting part detecting an advancing orientation of the own vehicle, by the in vehicle device;

a selecting part selecting an image to be displayed on the basis of the advancing orientation detected by the detection part and the imaging orientation information received by the receiving part; and a displaying part displaying the image selected by the selecting part and the own vehicle position specified by the specifying part on the image of the display device.

4. The in-vehicle device according to claim 3, wherein the receiving part further includes:

an identifier receiving part receiving receives an identifier for identifying an imaging device which has acquired the image data; and includes a storage storing, in plurals, a conversion equation for converting the positional information of the own vehicle to an own vehicle position in the image in correspondence to the identifier on the basis of the corresponding information, and the specifying part specifies the own vehicle position on the image on the basis of the conversion equation corresponding to the identifier received by the receiving part.

5. The in-vehicle device according to claim 1, further comprising:

a setting part setting a priority to at least one of a straight direction, a left-turn direction, and a right-turn direction of the own vehicle; and a deciding part deciding an imaging orientation corresponding to a direction with highest priority that is set by the setting part on the basis of the advancing orientation detected by the detection part, wherein the selection part selects an image of the imaging orientation decided by the deciding part.

6. The in-vehicle device according to claim 1, wherein the displaying part displays the advancing direction detected by the detection part on the display device.

7. The in-vehicle device according to claim 3, further comprising:

a determining part determining whether the own vehicle exists in the imaging region on the basis of the positional information contained in the corresponding information received by the receiving part and the positional information acquired by the acquiring part; and a notifying part making a notification when determined that the own vehicle does not exist in the imaging region by the determining part.

8. The in-vehicle device according to claim 3, further comprising:

a determining part determining whether the own vehicle exists in the imaging region on the basis of the positional information contained in the corresponding information received by the receiving part and the positional information acquired by the acquiring part, wherein the displaying part displays a direction the own vehicle exists at a periphery of the image on the display device when determined that the own vehicle does not exist in the imaging region by the determining part.

9. A computer-readable non-transitory medium which stores a computer-executable program for causing an in-vehicle device connectable to both a display device and a road-side device to display an own vehicle position on the display device, the program making the in-vehicle device execute:

a receiving part receiving image data obtained by imaging an imaging region including roads and imaging orientation information identifying the imaging orientation of the road-side device with image data of different imaging orientation;

specifying the own vehicle position on the image on the basis of corresponding information, in which a pixel coordinate in the image and positional information of the imaging region are corresponded to each other, and positional information of the own vehicle;

a detecting part detecting an advancing orientation of the own vehicle, by the in vehicle device, a selecting part selecting an image data for an image to be displayed on the basis of the advancing orientation detected by the detection part and the imaging orientation information received by the receiving part, displaying the image, for which the image data is selected by the selecting part, and the specified own vehicle position on the image on the basis of the received image data in the display device.

10. The in-vehicle device according to claim 3, further comprising:

a storage storing the priority table defining the priority of the monitoring direction in accordance with the advancing orientation and the imaging orientation, wherein the selection part selects an image on the basis of the priority table.

* * * * *